US006032693A

United States Patent [19]

Home

[11] Patent Number: 6,032,693

[45] Date of Patent: Mar. 7, 2000

[54] SOLENOID VALVE ASSEMBLY FOR CONTROLLING GAS SUPPLY

[76] Inventor: William Home, 9 th Fl/3, No. 374, Sec. 2, Pa-Teh Rd., Taipei, Taiwan

[21] Appl. No.: 08/887,168

[22] Filed: Jul. 1, 1997

[51] Int. Cl.[7] ..... F16K 31/04

[52] U.S. Cl. ..... 137/870; 137/878

[58] Field of Search ..... 137/870, 878, 137/883

[56] References Cited

U.S. PATENT DOCUMENTS 2,905,189 9/1959 Matthews ..... 137/870 X 5,353,828 10/1994 Troscinski ..... 137/870 X

*Primary Examiner*—John Fox

[57] ABSTRACT

A solenoid valve assembly for controlling gas supply includes a lower cover formed with a first chamber at an end thereof, a second chamber located adjacent to and communicating with the first chamber, a third chamber located adjacent to the second chamber, a fourth chamber located adjacent to and communicating with the third chamber, and a fifth chamber located at another end thereof and communicating with the fourth chamber, a base plate fixedly mounted on a bottom of the lower cover, a diaphragm mounted between the base and the bottom of the lower cover, a spring arranged between the base plate and the diaphragm, an upper cover formed with a first cavity at an end thereof, a second cavity at an intermediate portion thereof and a third cavity at another end thereof, whereby the solenoid valve assembly can be used for controlling for controlling gas supply to a main and an auxiliary burners as desired.

2 Claims, 4 Drawing Sheets

SOLENOID VALVE ASSEMBLY FOR CONTROLLING GAS SUPPLY

BACKGROUND OF THE INVENTION

1. Field of the Invention

This invention is related to a solenoid valve assembly for controlling gas supply and in particular to one for controlling gas supply to a main burner and an auxiliary burner.

2. Description of the Invention

It has been found that the conventional gas burner is ignited by depressing and holding a button until the thermocouple in the gas burner generates a steady current to the control board. However, the operation for igniting the gas burner requires the user to hold the button for a certain period of time thereby causing much inconvenience in use. Hence, it is proposed to use a battery to ignite the gas burner in order to eliminate this drawback, but the service life of the battery is limited and will not be able to ignite the gas burner in case the battery is flat.

Therefore, it is an object of the present invention to provide an apparatus for controlling gas supply to gas burners which can obviate and mitigate the above-mentioned drawbacks.

SUMMARY OF THE INVENTION

This invention is related to a solenoid valve assembly for controlling gas supply to a main and an auxiliary burners.

It is the primary object of the present invention to provide a solenoid valve assembly for controlling gas supply to a main and an auxiliary burners which is compact in size.

It is another object of the present invention to provide a solenoid valve assembly for controlling gas supply to a main and an auxiliary burners which is simple in construction.

It is still another object of the present invention to provide a solenoid valve assembly for controlling gas supply to a main and an auxiliary burners which is fit for practical use.

It is still another object of the present invention to provide a solenoid valve assembly for controlling gas supply to a main and an auxiliary burners which is cheap to manufacture.

It is a further object of the present invention to provide a solenoid valve assembly for controlling gas supply to a main and an auxiliary burners which is easy to operate.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numberals refer to identical or similar parts.

DETAILED DESCRIPTION OF THE PREFERRED EMBODIMENT

Figure 1:
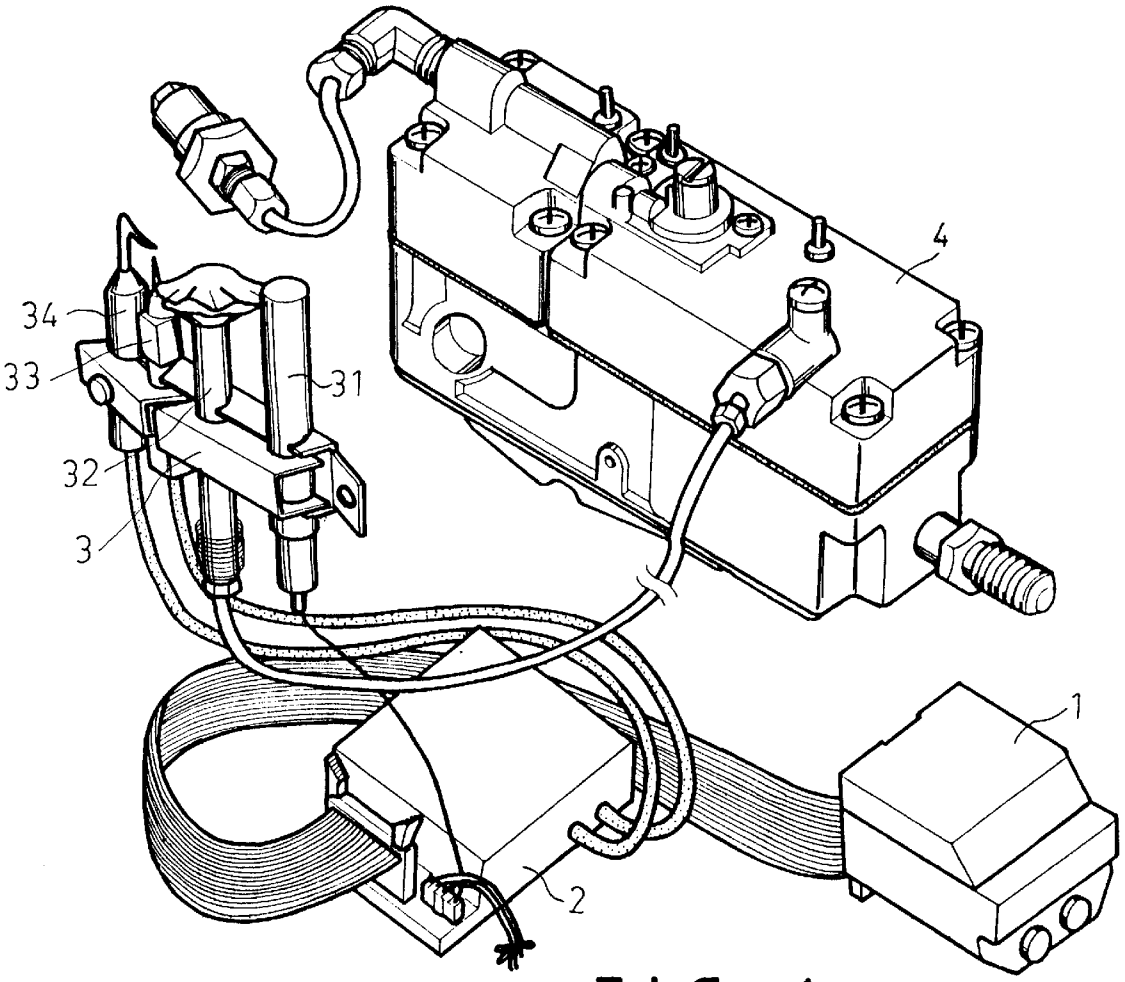
FIG. 1 is a perspective view of an apparatus for controlling gas supply according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

With reference to FIG. 1, the apparatus for controlling gas supply according to the present invention generally comprises a battery supply 1, a control board 2, a pilot seat 3, and a solenoid valve assembly 4.

Figure 2:
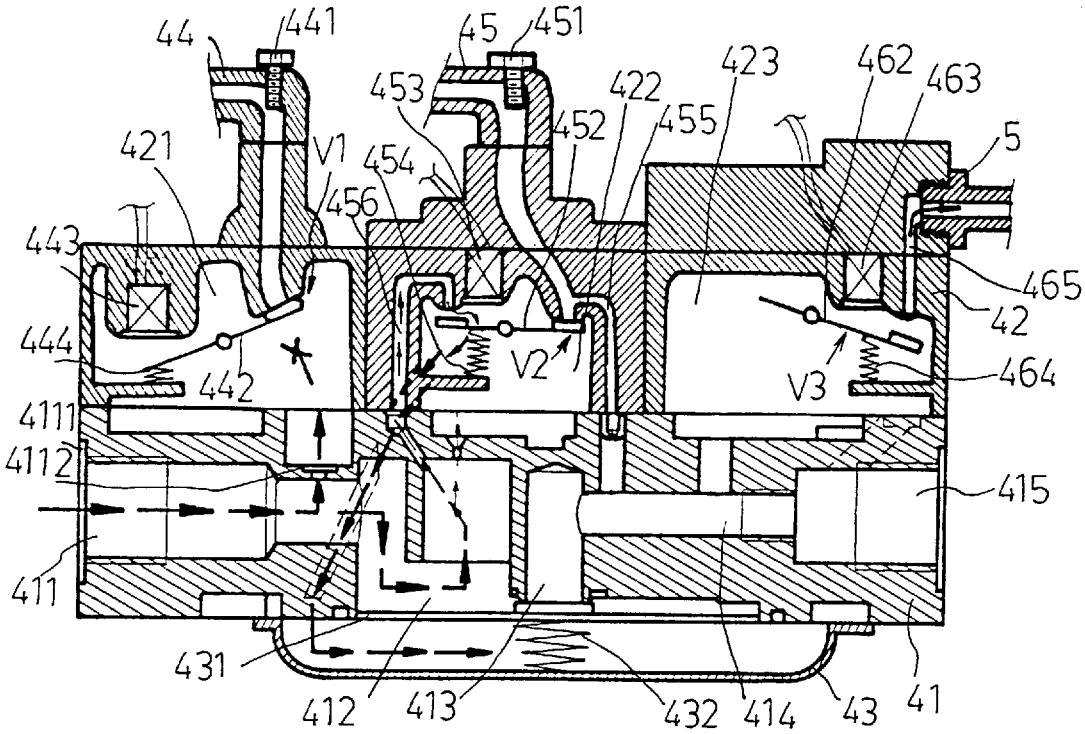
FIGS. 2 and 3 are sectional views showing the working principle of the solenoid valve when connected with two burners.

As shown in FIG. 2, the solenoid valve assembly 4 mainly comprises a lower cover 41, an upper cover 42 fixedly mounted on the lower cover 41 by screws (not shown), and a base plate 43 fastened on the bottom of the lower cover 41. The lower cover 41 is formed with a first chamber 411 at the left end (with respect to FIG. 2), a second chamber 412 located adjacent to and communicating with the first chamber 411, a third chamber 413 located adjacent to the second chamber 412, a fourth chamber 414 located adjacent to and communicating with the third chamber 413, and a fifth chamber 415 located at the right end and communicating with the fourth chamber 414. The first chamber 411 is a horizontal passage having an inlet 4111 for connecting a gas supply (not shown) and communicating with the second chamber 412 which is open at the bottom. The third chamber 413 is a vertical passage which is blind at the top and open at the bottom. The upper portion of the third chamber 413 communicates with the fourth chamber 414 which is a horizontal passage. The fourth chamber 414 communicates with the fifth chamber 415 which has a larger diameter than the fourth chamber 414. The fifth chamber 415 is adapted to be connected to a main burner 8 (see FIG. 6).

The base plate 43 is fixedly mounted on the bottom of the lower cover 41 by screws (not shown) or otherwise secured thereto. Between the base plate 43 and the bottom of the lower cover 42 there is mounted a diaphragm 431. A spring 432 is arranged between the base plate 43 and the diaphragm 431 thereby urging the diaphragm 431 to go upwardly to close the bottom of the second and third chambers 412 and 413.

The upper cover 42 is formed with a first cavity 421 at the left end (with respect to FIG. 2), a second cavity 422 at the intermediate portion, and a third cavity 423 at the right end. The top of the upper cover 41 has a first passage 44 for connecting the pilot burner 32 and a second passage 45 for connecting a regulator (not shown). The upper end of the second passage 45 is provided with an adjust screw 451.

The first passage 44 communicates with the upper portion of the first cavity 421. The first passage 44 is provided with an adjust screw 441 for controlling the flow rate of the gas to the pilot burner 32. A solenoid 443 is fitted in the upper portion of the first cavity 421. A lever 442 is pivotally mounted within the first cavity 421 and has a first and second ends right under the solenoid 443 and the first passage 44 respectively. A tension spring 444 is connected at the upper end with the first end of the lever 442 and at the lower end with the lower portion of the first cavity 421 so that the spring 444 tends to pull the first end of the lever 442 to go downwardly thereby rotating the inlet of the second end of the lever 442 to go upwardly against the first passage 44 and therefore forming a normal closed pilot valve V1. As the solenoid 443 is induced, the first end of the lever 442 will be attracted to go upwardly thereby rotating the second end of the lever 442 to go downwardly and therefore opening the inlet of the first passage 44. Consequently, only when the solenoid 443 is activated will the pilot valve V1 be open. The first cavity 421 of the upper cover 42 communicates with the first chamber 411 of the lower cover 41 via an orifice 4112.

The second passage 45 communicates with the upper portion of the second cavity 422 of the upper cover 42. The second passage 45 is provided with an adjust screw 451 at the top for controlling flow rate of the gas to a regulator (not shown). The second passage 45 has a branch passage 455 in communication with the fourth chamber 414 of the lower cover 41. The upper portion of the second cavity 422 communicates with an upper end of a vent 456. The lower end of the vent 456 communicates with the second chamber 412 of the lower cover 41. The second cavity 422 communicates with the space formed between the base plate 43 and the diaphragm 431. A solenoid 453 is fitted in the upper portion of the second cavity 422. A lever 452 is pivotally mounted within the second cavity 422 and has a first and second ends right under the upper end of the vent 456 and the inlet of the second passage 45 respectively. A solenoid 453 is fitted in the upper portion of the second cavity 422 and above the first end of the lever 452. A tension spring 454 is connected at the upper end with the first end of the lever 452 and at the lower end with the lower portion of the second cavity 422 so that the spring 454 tends to pull the first end of the lever 452 to go downwardly thereby rotating the second end of the lever 452 to go upwardly against the inlet of the second passage 45 and therefore forming a main burner valve V2 which is normally open at the right end and normally closed at the left end. When the solenoid 453 is induced, the first end of the lever 452 will be attracted to go upwardly thereby rotating the second end of the lever 452 to go downwardly and therefore opening the inlet of the second passage 45 and closing the upper end of the vent 456.

The third cavity 423 of the upper cover 42 communicates with the fourth and fifth chambers 414 and 415 of the lower cover 41 and has an upwardly extending through hole 465. The upper end of the upwardly extending through hole 465 is engaged with a connector which is in turn connected to an auxiliary burner 80 (see FIG. 6). A solenoid 463 is fitted in the upper portion of the third cavity 423. A lever 462 is pivotally mounted within the third cavity 423 and has a first end under the lower end of the through hole 465 and the solenoid 463. A tension spring 464 is connected at the upper end with the first end of the lever 462 and at the lower end with the lower portion of the first cavity 421 so that the spring 464 tends to pull the first end of the lever 442 to go downwardly thereby opening the through hole 465 and therefore forming a normal open auxiliary burner valve V3. Hence, only when the solenoid 463 is activated will the auxiliary burner valve V3 be open.

Figure 6:
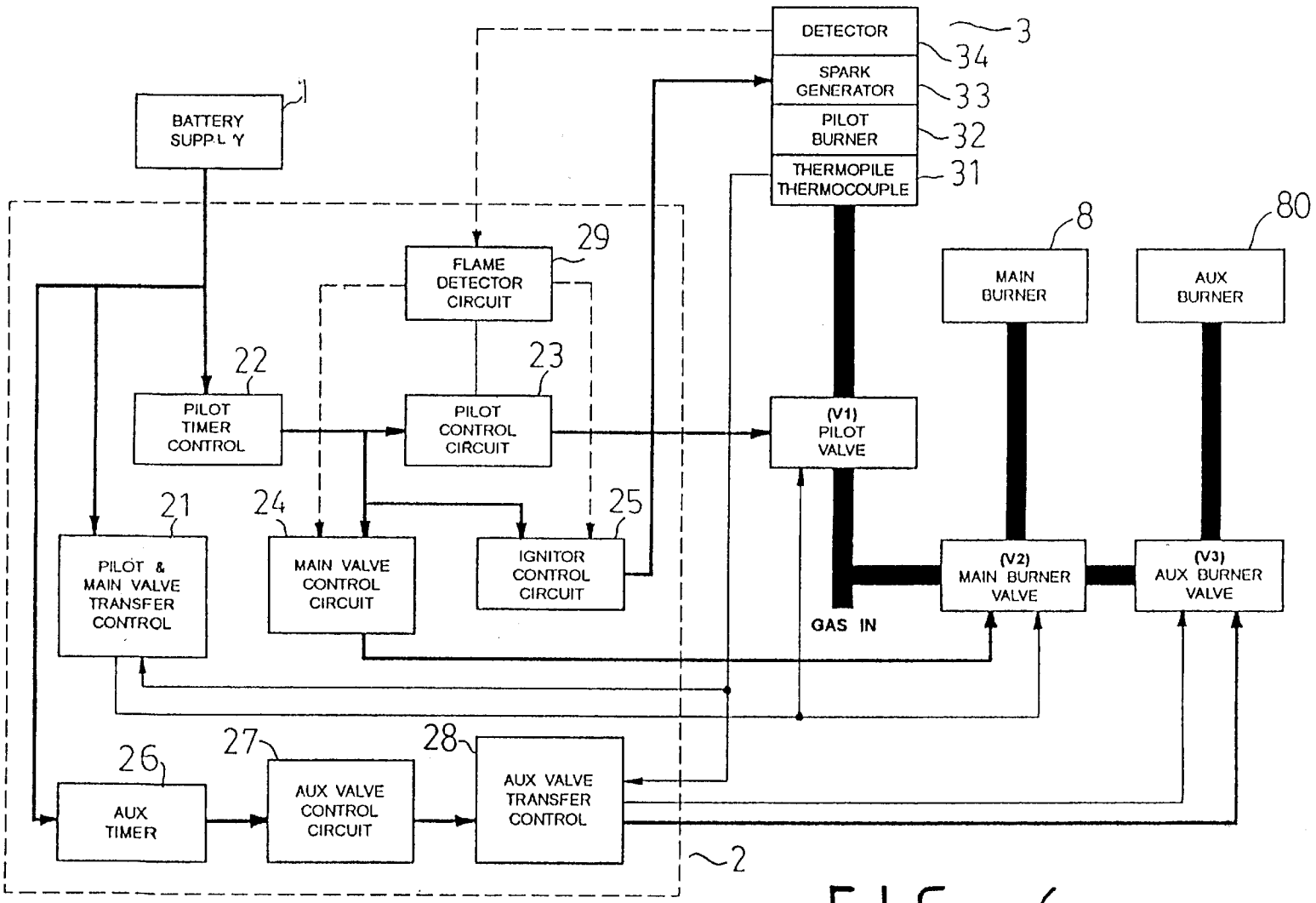
FIG. 6 is a block diagram of the apparatus for controlling gas supply.

Referring to FIGS. 1 and 6, the battery supply 1 includes a case in which are fitted dry batteries (not shown) for supplying direct current power to the control board 2.

The control board 2 includes a pilot and main valve transfer control 21, a pilot timer control 22, a pilot control circuit 23, a main valve control circuit 24, a ignitor control circuit 25, an auxiliary timer 26, an auxiliary valve control circuit 27, an auxiliary valve transfer control 28 and a flame detector circuit 29.

The pilot seat 3 is provided with a thermopile 31, a pilot burner 32, a spark generator 33 and a detector 34 which are closedly mounted thereon. The thermopile 32 may be replaced with a thermocouple (not shown) as required and designed for supplying power to the pilot and main valve transfer control 21 and the auxiliary transfer control 28. The spark generator 33 is connected and controlled by the ignitor control circuit 25. The detector 34 is a sensor for detecting the burning condition of the pilot burner 32 and sending the information to the flame detector circuit 29.

Figure 3:
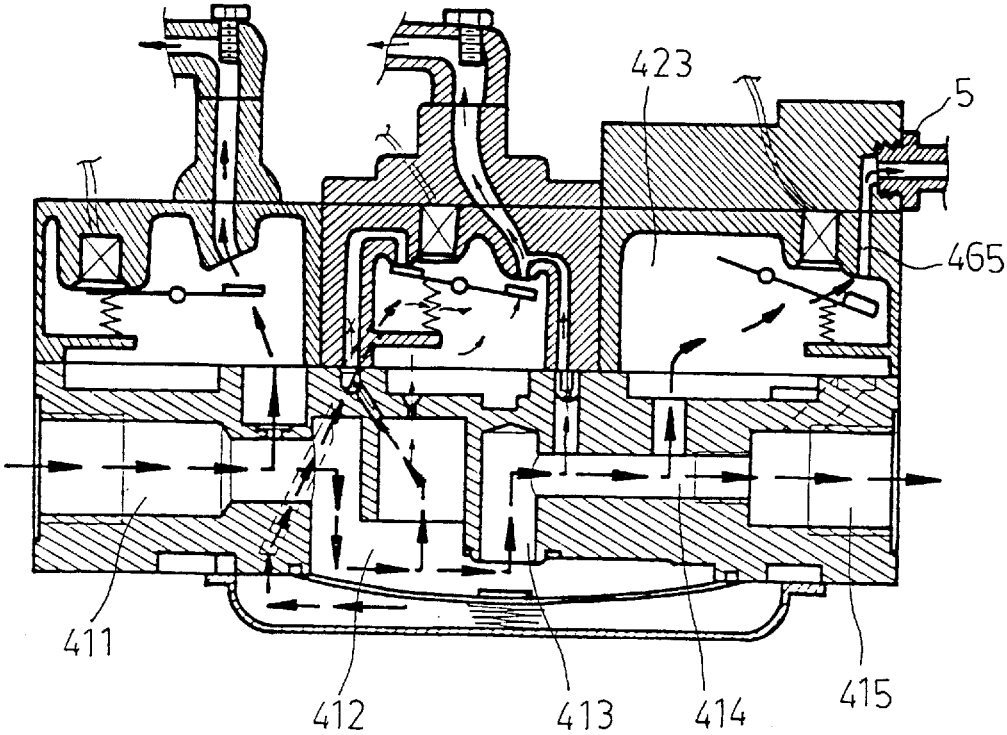

The pilot timer control 22 is preset so that it will let the electric current from the battery supply 1 flow therethrough for a time period of 20–30 seconds when switched on. The pilot timer control 22 is connected to the pilot control circuit 23 for controlling the electric current supplied to the pilot valve V1 from the battery supply 1. The pilot valve V1 has an inlet 4111 connected to a gas supply and an outlet 44 to the pilot burner 32 and is controlled by the pilot control circuit 23 so that when the pilot timer control 22 is switched on, the pilot valve V1 will be turned open letting the gas pass through the first passage 44 of the upper cover 42 to the pilot burner 32. In the meantime, the pilot timer control 22 will drive the ignitor control circuit 25 to trigger the spark generator 33 to ignite the pilot burner 32. The detector 34 is a sensor mounted close to the pilot burner 32 for detecting the burning condition of the pilot burner 32. If the pilot fire of the pilot burner 32 is steady, the detector 34 will send out a signal to the flame detector circuit 29 which will in turn make the ignitor control circuit 25 to cease producing sparks via the spark generator 33 and at the same time trigger the main valve control circuit 24 to open the main burner valve V2 to let the gas pass through the first chamber 411, the second chamber 412, the third chamber 413, the fourth chamber 414 and the fifth chamber 415 to the main burner 8 and the third cavity 423 the through hole 465 to the auxiliary burner 80 along the path shown by arrows in FIG. 3. If the main burner valve V2 is kept closed, the gas pressure above the diaphragm 431 will be just equal to that below the diaphragm 431 thereby cutting off the gas supply to the burners (see FIG. 2). However, if the pilot fire is not yet steady, the detector 34 will send a signal to the flame detector circuit 29 to make the ignitor control circuit 25 continue to produce sparks through the spark generator 33. As the main burner valve V2 is normally closed, no gas will flow therethrough to the main burner 8 thereby preventing gas leakage and possible accident. The battery supply 1 is also connected with the pilot and main valve transfer control 21 and the auxiliary timer 26. The auxiliary timer 26 is connected to the auxiliary control circuit 27 which is in turn connected to the auxiliary valve transfer control 28. The auxiliary valve transfer control 28 is connected to the thermopile 31 and the auxiliary burner valve V3. As the auxiliary timer 26 is turned on, the electric current from the battery supply 1 will flow through the auxiliary timer 26 to the auxiliary valve control circuit 27 which will cause the auxiliary valve transfer control 28 to open the auxiliary burner valve V3 thereby enabling the gas to flow to the auxiliary burner 80. The auxiliary timer 26 is preset so that it will let the electric current from the battery supply 1 flow therethrough for 1–2 seconds when switched on. The thermopile 31 is mounted on the pilot seat 2 and arranged close to the pilot burner 32. When the main burner 8 burns, the thermopile 31 will generate electric current and supply electric power to the pilot and main valve transfer control 21 and the auxiliary valve transfer control 28 thereby making the pilot and main transfer control 21 to cut off the battery supply 1 to the control board 2 and making the auxiliary valve transfer control 28 to keep the auxiliary burner valve V3 open. As a result, when the main burner 8 burns for a certain predetermined period of time, the battery supply 1 will be cut off from the control board 2 and the power required for the operation of the apparatus will be supplied by the thermopile 31 instead of the battery supply 1.

Figure 4:
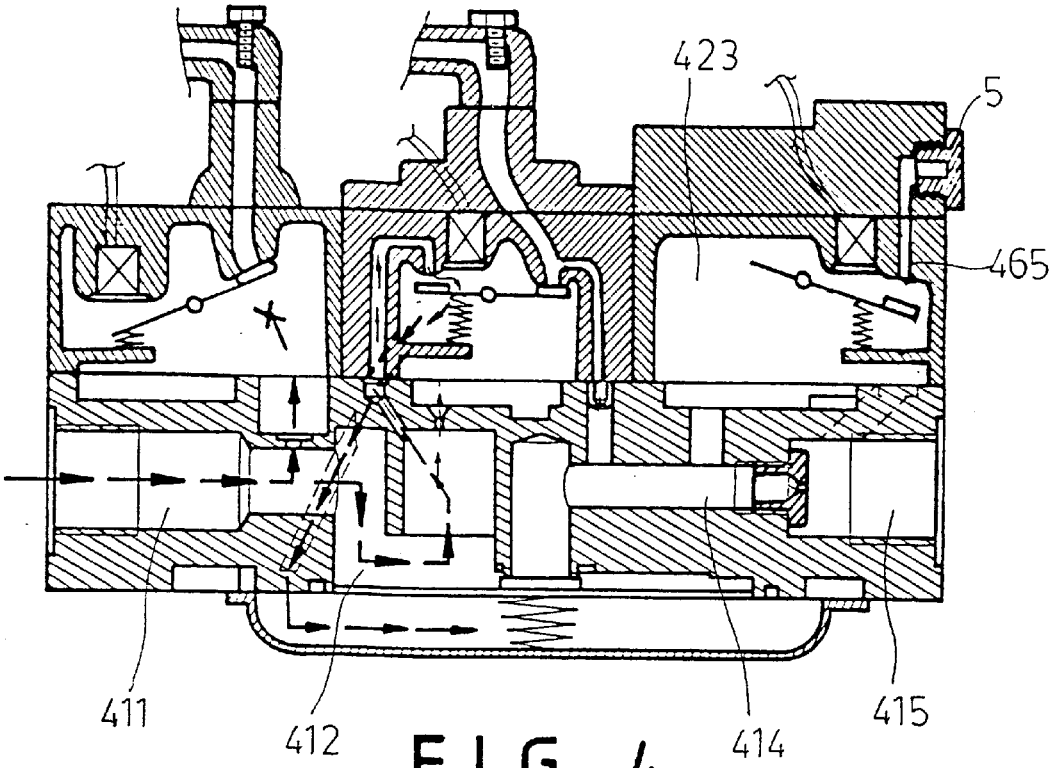
FIGS. 4 and 5 are sectional views showing the working principle of the solenoid valve when connected with a single burner.
Figure 5:
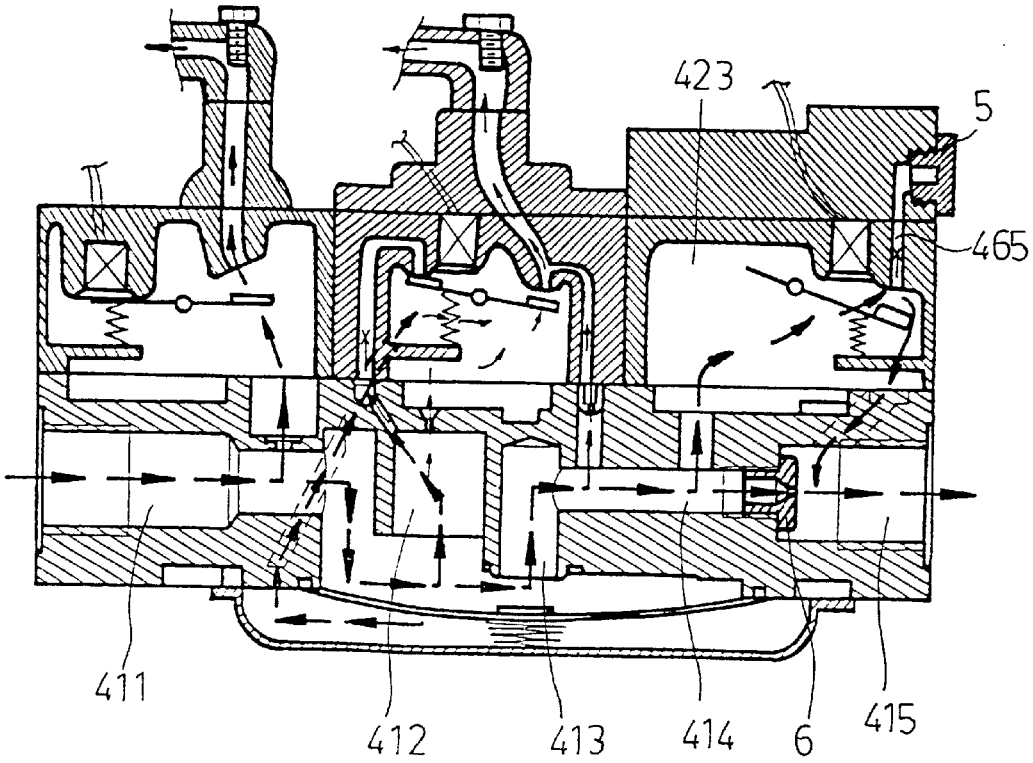

When there is only one burner, it is only necessary to close the outlet of the through hole 465 with a plug 51 (see FIGS. 4 and 5). Further, when desired to reduce the flow rate of the single burner, simply engage a nozzle 6 with the outlet of the fourth chamber 414 of the lower cover 41 as shown in FIGS. 4 and 5.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A solenoid valve assembly for controlling gas supply comprising:

a lower cover formed with a first chamber at an end thereof, a second chamber located adjacent to and communicating with said first chamber, a third chamber located adjacent to said second chamber, a fourth chamber located adjacent to and communicating with said third chamber, and a fifth chamber located at another end thereof and communicating with said fourth chamber, said first chamber being a horizontal passage having an inlet for connecting a gas supply and communicating with said second chamber which is open at a bottom thereof, said third chamber being a vertical passage which is blind at a top and open at a bottom thereof, an upper portion of said third chamber communicating with said fourth chamber which is a horizontal passage, said fourth chamber communicating with said fifth chamber which has a larger diameter than said fourth chamber, said fifth chamber being adapted to be connected to a main burner;

a base plate fixedly mounted on a bottom of said lower cover;

a diaphragm mounted between said base and a bottom of said lower cover;

a spring arranged between said base plate and said diaphragm thereby urging said diaphragm to go upwardly to close the bottom of said second and third chambers of said lower cover;

an upper cover formed with a first cavity at an end thereof, a second cavity at an intermediate portion thereof and a third cavity at another end thereof, a top of said upper cover having a first passage adapted to be connected to a pilot burner and a second passage adapted to be connected to a regulator, said first passage communicating with an upper portion of said first cavity and provided with an adjust screw for controlling flow rate of gas to said pilot burner, a first solenoid fitted in an upper portion of said first cavity, a first lever being pivotally mounted within said first cavity and having a first and second ends right under said first solenoid and said first passage respectively, a first tension spring having an upper end connected with a first end of said first lever and a lower end connected with a lower portion of said first cavity, said first cavity communicating with said first chamber via an orifice, said second passage communicating with an upper portion of said second cavity, said second passage being provided with an adjust screw at a top thereof for controlling gas flow rate, said second passage having a branch passage in communication with said fourth chamber, an upper portion of said second cavity communicating with an upper end of a vent passage, a lower end of said vent communicating with said second chamber, said second cavity communicating with a space formed between said base plate and said diaphragm, a second solenoid being fitted in an upper portion of said second cavity, a second lever being pivotally mounted within said second cavity and having a first and second ends right under an upper end of said vent and an inlet of the second passage respectively, a third solenoid being fitted in an upper portion of said second cavity and above the first end of said second lever, a second tension spring having an upper end with the first end of said first lever and a lower end with a lower portion of said second cavity, said third cavity communicating with said fourth and fifth chambers and having an upwardly extending through hole, an upper end of said upwardly extending through hole being adapted to engage with an auxiliary burner, a third solenoid fitted in an upper portion of said third cavity, a third lever pivotally mounted within said third cavity and having a first end under a lower end of said through hole and said third solenoid, a third tension spring having an upper end connected with said first end of said second lever 462 and a lower end with a lower portion of said first cavity.

2. The solenoid valve assembly for controlling gas supply as claimed in claim 1, further comprising a nozzle fitted in an outlet of said fourth chamber of said lower cover.

* * * * *